US005931724A

United States Patent [19]

Perlov et al.

[11] Patent Number: 5,931,724

[45] Date of Patent: Aug. 3, 1999

[54] MECHANICAL FASTENER TO HOLD A POLISHING PAD ON A PLATEN IN A CHEMICAL MECHANICAL POLISHING SYSTEM

[75] Inventors: Ilya Perlov; Eugene Gantvarg, both of Santa Clara, Calif.

[73] Assignee: Applied Materials, Inc., Santa Clara, Calif.

[21] Appl. No.: 08/891,549

[22] Filed: Jul. 11, 1997

[51] Int. Cl.[6] ..... B24B 5/00

[52] U.S. Cl. ..... 451/285; 451/41; 451/60; 451/921; 451/288; 403/321; 285/320

[58] Field of Search ..... 451/41, 288, 921, 451/60, 285, 522, 512; 403/83–95, 321, 338, 373; 285/320

[56] References Cited

U.S. PATENT DOCUMENTS

| | | |
|---|---|---|
| 3,342,652 | 9/1967 | Reisman et al. . |
| 3,708,921 | 1/1973 | Cronkhite et al. . |
| 3,731,435 | 5/1973 | Boettcher et al. . |
| 3,841,031 | 10/1974 | Walsh . |
| 3,898,770 | 8/1975 | Benz et al. . |
| 3,913,271 | 10/1975 | Boettcher . |
| 4,519,168 | 5/1985 | Cesna . |
| 4,918,870 | 4/1990 | Torbert et al. . |
| 4,940,507 | 7/1990 | Harbarger . |
| 5,246,525 | 9/1993 | Sato . |
| 5,421,769 | 6/1995 | Schultz et al. . |
| 5,498,199 | 3/1996 | Karlsrud et al. . |
| 5,647,792 | 7/1997 | Katsuoka et al. . |
| 5,679,064 | 10/1997 | Nishi et al. . |
| 5,704,827 | 1/1998 | Nishi et al. . |

FOREIGN PATENT DOCUMENTS

| | | | |
|---|---|---|---|
| 463006 | of 1928 | Germany | 403/321 |
| 230827 | of 1984 | Japan | 451/288 |
| 35413 | of 1991 | Japan | 451/285 |
| 279903 | of 1964 | Netherlands | 403/321 |

*Primary Examiner*—Robert A. Rose
*Assistant Examiner*—George Nguyen
*Attorney, Agent, or Firm*—Fish & Richardson

[57] ABSTRACT

A chemical mechanical polishing apparatus includes a rotatable platen for receiving a polishing pad. The polishing pad is attached to a polishing pad support plate. The polishing pad support plate is removably secured to the platen by a fastening assembly.

18 Claims, 6 Drawing Sheets

MECHANICAL FASTENER TO HOLD A POLISHING PAD ON A PLATEN IN A CHEMICAL MECHANICAL POLISHING SYSTEM

BACKGROUND OF THE INVENTION

The present invention relates generally to chemical mechanical polishing of substrates, and more particularly to holding a polishing pad on a platen in a chemical mechanical polishing system.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the exposed surface of the substrate becomes increasingly non-planar. This non-planar surface presents problems in the photolithographic steps of the integrated circuit fabrication process. Therefore, there is a need to periodically planarize the substrate surface to provide a flat surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be a "standard" pad in which the polishing pad surface is a durable roughened surface, or a fixed-abrasive pad in which abrasive particles are held in a containment media. The carrier head provides a controllable load, i.e., pressure, on the substrate to push it against the polishing pad. A polishing slurry, including at least one chemically-reactive agent, and abrasive particles if a standard pad is used, is supplied to the polishing pad to provide an abrasive chemical solution at the interface between the pad and the substrate. The reactive agent in the slurry reacts with the outer surface of the substrate to form reactive sites. The interaction of the polishing pad and the abrasive particles with the reactive sites on the substrate results in polishing.

The effectiveness of a CMP process may be measured by its polishing rate, and by the resulting finish (absence of small-scale roughness) and flatness (absence of larges-scale topography) of the substrate surface. The polishing rate, finish and flatness are determined by the pad and slurry combination, the relative speed between the substrate and pad, and the force pressing the substrate against the pad. The polishing rate sets the time needed to polish a layer. Because inadequate flatness and finish can create defective substrates, the selection of a polishing pad and slurry combination is usually dictated by the required finish and flatness. Given these constraints, the polishing time needed to achieve the required finish and flatness sets the maximum throughput of the polishing apparatus.

During the CMP process, the polishing pad is periodically replaced. For a fixed-abrasive pad, the substrate wears away the containment media to expose the embedded abrasive particles. Thus, the fixed-abrasive pad is gradually consumed by the polishing process. After a sufficient number of polishing runs (e.g., forty to fifty) the fixed-abrasive pad needs to be replaced. For a standard pad, the substrate thermally and mechanically damages the polishing pad and causes the pad's surface to become smoother and less abrasive. Therefore, standard pads must be periodically "conditioned" to restore a roughened texture to their surface. After a sufficient number of conditioning operations (e.g., three hundred to four hundred), the conditioning process consumes the pad or the pad is unable to be properly conditioned. The pad must then be replaced.

One problem encountered in the CMP process is the difficulty in replacing the polishing pad. The polishing pad may be attached to the platen surface with an adhesive. A significant physical effort is often required to peel the polishing pad away from the platen surface. The adhesive then must be removed from the platen surface by scraping and washing with a solvent. A new polishing pad can then be adhesively attached to the clean surface of the platen. While this is happening, the platen is not available for the polishing of substrates, resulting in a decrease in polishing throughput. The problems are even more acute for fixed abrasive pads, since they must be changed even more frequently than standard pads.

In view of the foregoing, there is a need for a CMP apparatus in which the polishing pad may be quickly and easily replaced.

SUMMARY OF THE INVENTION

In one aspect, the invention is directed to a chemical mechanical polishing apparatus. The apparatus comprises a pad support plate, a polishing pad attachable to a top surface of the pad support plate, and a rotatable platen on which the pad support pad plate may be supported. A projection extends from a bottom surface of the pad support plate, and the platen includes at least one aperture to receive the projection. A fastener is configured to engage the projection and secure the pad support plate to the platen.

Implementations of the invention may include the following. The apparatus may comprise a slurry supply, a passage through the platen, and a pump to pump slurry from the slurry supply through the passage to a top surface of the platen. The platen may include at least one cavity, and the fastener may be at least partially disposed in the cavity. The aperture may provides a passage between a top surface of the platen and the cavity, and the projection may extend into the cavity. The fastener may include an arm pivotally movable between a first position in which the arm engages the projection and a second position in which the arm does not engage the projection. The arm may include two finger portions forming a gap therebetween, and in the first position a shank of the projection may be located in the gap between the two finger portions. The projection may includes a head having a diameter greater than the distance across the gap so that in the first position, a top surface of the head contacts a bottom surface of the arm.

In another aspect, the invention is directed to an assembly for a chemical mechanical polishing apparatus. The assembly comprises a rotatable platen having a recess in a surface thereof, and an arm positionable at least partially in the recess. The arm is pivotally movable between a first position in which the arm engages a projection of a pad support plate and a second position in which the arm does not engage the projection.

Implementations of the invention may include the following. The recess may be located on an outer cylindrical surface of the platen, and the platen may include a passage between a top surface of the platen and the recess.

In another aspect, the invention is directed to an article for use with a chemical mechanical polishing apparatus. The article comprises a substantially rigid disk-shaped member, a plurality of pins projecting from a bottom surface of the disk-shaped member, the pins positioned and configured to fit into apertures in a top surface of a platen, and a polishing pad attachable to a top surface of the disk-shaped member.

In another aspect, the invention is directed to a chemical mechanical polishing apparatus. The apparatus comprises a pad support plate, a polishing pad attached to a top surface of the pad support plate, and a rotatable platen having a top surface to support the pad support pad plate. A plurality of pins extend from a bottom surface of the pad support plate, and the platen has a plurality of cavities and a plurality of apertures connecting the top surface to the cavities and configured to receive the pins. A plurality of fasteners are connected to the platen, and each fastener is disposed at least partially in one of the cavities and is movable between a first position in which the fastener engages one of the pins to secure the pad support plate to the platen and a second position in which the fastener does not engage that pin.

Implementations of the invention may include the following. The platen may include a platen top having a plurality of recesses formed in a bottom surface thereof, and a platen base secured to the bottom surface of the platen top, the recesses between the platen top and platen base forming the cavities. The fasteners may be disposed at equal angular intervals about the periphery of the platen. There may be three cavities, three fasteners and three pins.

In another aspect, the invention is directed to a method of securing a polishing pad to a platen. In the method, a polishing pad is attached to a pad support plate having a projection extending from a bottom surface thereof. The pad support plate is positioned on a platen so that the projection extends at least partially into an aperture in the platen, and a fastener connected to the platen is moved to engage the projection.

Advantages of the invention may include one or more of the following. A pad support plate with a polishing pad may be reliably secured to a platen. However, it is easy to remove the pad support plate and the polishing pad from the platen. A used polishing pad may be removed from one pad support plate while a fresh polishing pad on another pad support plate is used for polishing. As a result, downtime of the CMP apparatus is reduced and throughput is increased.

Other features and advantages of the invention will be apparent from the description which follows, including the drawings and claims.

DETAILED DESCRIPTION OF THE INVENTION

Figure 1:
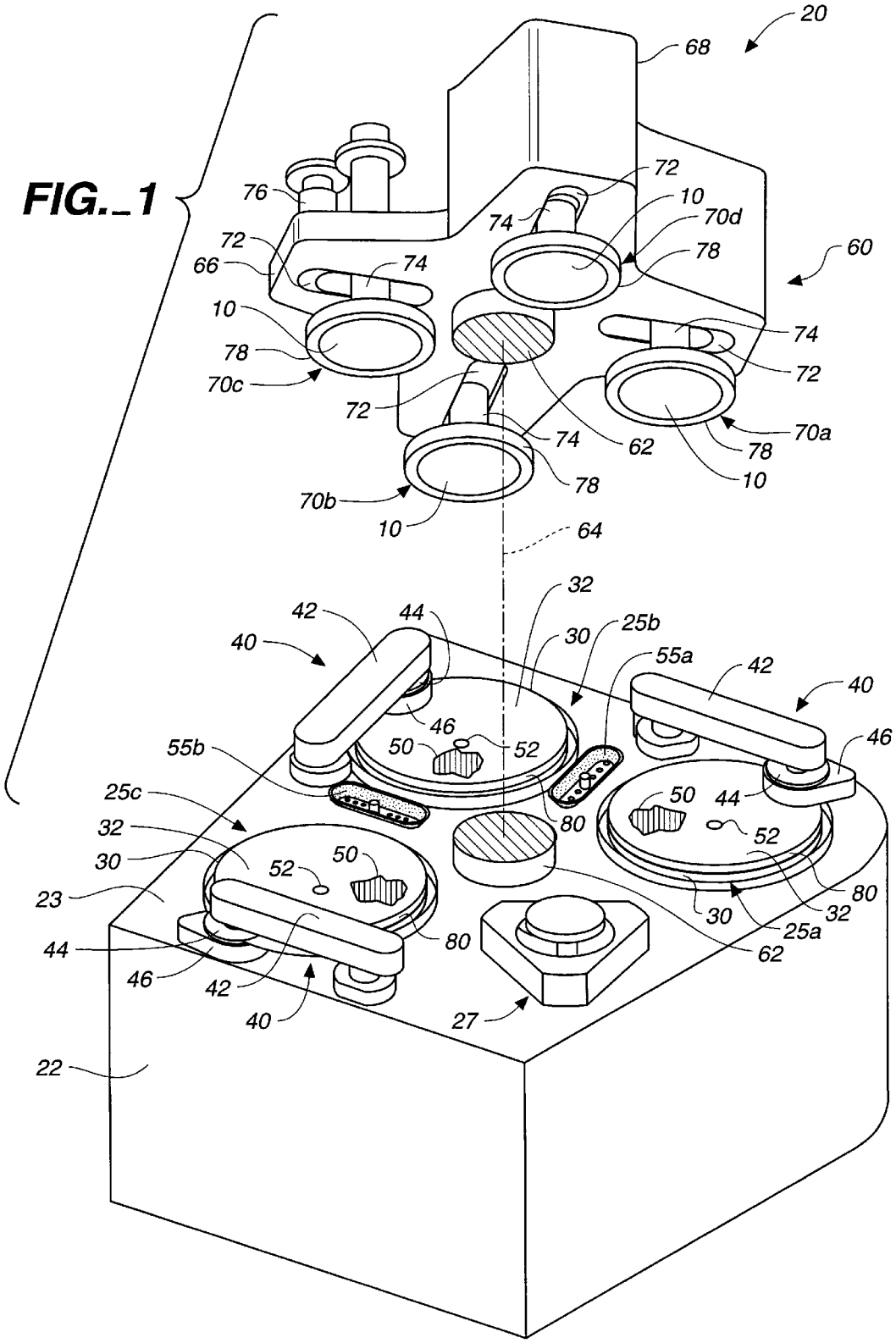
FIG. 1 is a schematic exploded perspective view of a CMP apparatus.

Referring to FIG. 1, one or more substrates 10 may be polished by a CMP apparatus 20. A description of CMP apparatus 20 may be found in U.S. patent application Ser. No. 08/549,336, entitled RADIALLY OSCILLATING CAROUSEL PROCESSING SYSTEM FOR CHEMICAL MECHANICAL POLISHING, filed Oct. 27, 1995, by Ilya Perlov, et al., assigned to the assignee of the present invention, the entire disclosure of which is incorporated herein by reference. The CMP apparatus 20 includes a lower machine base 22 with a table top 23 mounted thereon and a removable outer cover (not shown). Table top 23 supports a series of polishing stations 25*a*, 25*b* and 25*c*, and a transfer station 27. Transfer station 27 forms a generally square arrangement with the three polishing stations 25*a*, 25*b* and 25*c*. Transfer station 27 serves multiple functions, including receiving individual substrates 10 from a loading apparatus (not shown), washing the substrates, loading the substrates into carrier heads, receiving the substrates from the carrier heads, washing the substrates again, and finally, transferring the substrates back to the loading apparatus.

Each polishing station 25*a*–25*c* includes a rotatable platen or platen assembly 30 on which is placed a pad support plate 80 and a polishing pad 32. If substrate 10 is an eight inch (200 millimeter) diameter disk, then platen assembly 30, pad support plate 80, and polishing pad 32 will be about twenty inches in diameter. Platen assembly 30 preferably includes a rotatable aluminum or stainless steel plate connected to a platen drive motor (see FIG. 6). For most polishing processes, the platen drive motor rotates platen assembly 30 at thirty to two hundred revolutions per minute, although lower or higher rotational speeds may be used.

In addition, each polishing station includes a pad fastening system with a plurality of pad fastening assemblies 200 (see FIG. 5), described in detail below. The pad fastening system secures the pad support plate and polishing pad to the platen assembly.

Each polishing station 25*a*–25*c* also may include an associated pad conditioner apparatus 40, which is used to condition the polishing pad on the platen assembly 30. Each pad conditioner apparatus 40 has a rotatable arm 42 holding an independently rotating conditioner head 44 and an associated washing basin 46. The conditioner apparatus maintains the condition of the polishing pad so it will effectively polish any substrate pressed against it while it is rotating.

A slurry 50 containing a reactive agent (e.g., deionized water for oxide polishing) and a chemically-reactive catalyzer (e.g., potassium hydroxide for oxide polishing) is supplied to the surface of polishing pad 32 by a slurry supply port 52. If polishing pad 32 is a standard pad, slurry 50 may also include abrasive particles (e.g., colloidal silicon oxide). Sufficient slurry is provided to cover and wet the entire polishing pad 32. Optionally, two or more intermediate washing stations 55*a* and 55*b* may be positioned between neighboring polishing stations 25*a*, 25*b* and 25*c*. The washing stations rinse the substrates as they pass from one polishing station to another.

A rotatable multi-head carousel 60 is positioned above lower machine base 22. Carousel 60 is supported by a center post 62 and is rotated thereon about a carousel axis 64 by a carousel motor assembly located within machine base 22. Center post 62 supports a carousel support plate 66 and a cover 68. The carousel 60 includes four carrier head systems 70*a*, 70*b*, 70*c* and 70*d*. Three of the carrier head systems receive and hold substrates, and polish them by pressing them against the polishing pads on the platen assemblies of polishing stations 25*a*–25*c*. One of the carrier head systems receives a substrate from and delivers a substrate to transfer station 27.

The four carrier head systems 70*a*–70*d* may be mounted on carousel support plate 66 at equal angular intervals about carousel axis 64. Center post 62 allows the carousel motor to rotate the carousel support plate 66 and to orbit the carrier head systems 70*a*–70*d* and the substrates attached thereto about carousel axis 64.

Each carrier head system 70*a*–70*d* includes a polishing or carrier head 78. Each carrier head 78 independently rotates about its own axis, and independently laterally oscillates in a radial slot 72 formed in carousel support plate 66. A carrier drive shaft 74 connects a carrier head rotation motor 76 to carrier head 78 (shown by the removal of one quarter of cover 68). There is one carrier drive shaft and motor for each head.

Figure 2:
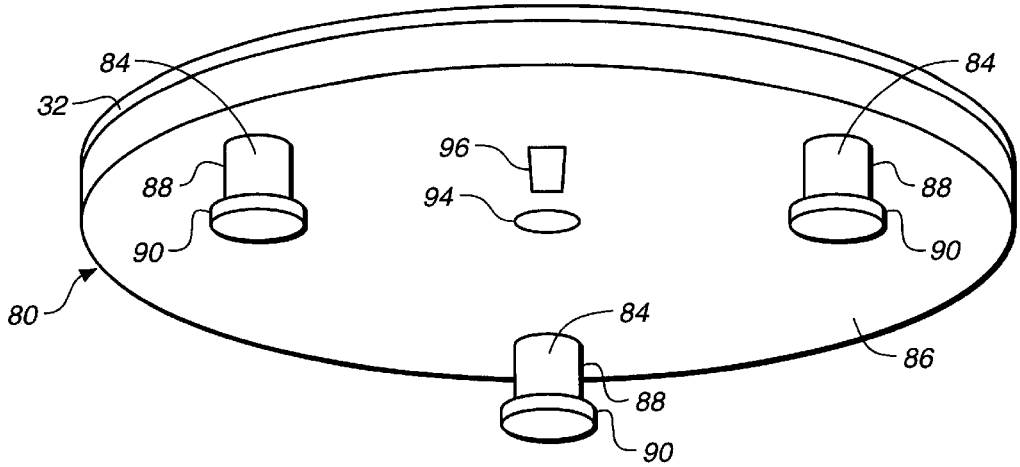
FIG. 2 is a schematic perspective bottom view of a pad support plate with an attached polishing pad in accordance with the present invention.
Figures 3A, 3B:
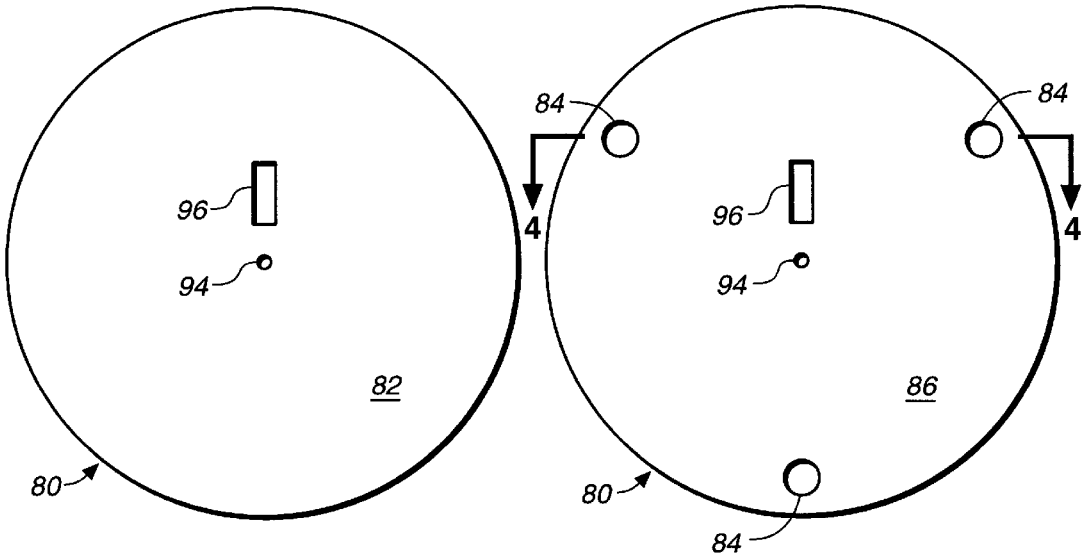
FIGS. 3A and 3B are schematic top and bottom views, respectively, of the polishing pad support plate of FIG. 2, without the polishing pad attached.

Referring to FIGS. 2, 3A and 3B, each pad support plate 80 may be a substantially rigid body having substantially the same shape as the top surface of the platen assembly. For example, pad support plate 80 may be a machined aluminum or stainless steel disk having a diameter of about twenty inches and a thickness of about ⅜ of an inch. Polishing pad 32 may be attached to a top surface 82 of pad support plate 80. A plurality of fastening pins 84, the purpose of which will be explained below, are attached to an underside 86 of pad support plate 80. There may be three fastening pins 84 located at equal angular intervals near the perimeter of the pad support plate. Each fastening pin 84 includes a cylindrical shank section 88 and a diskshaped head section 90. The fastening pins 84 may be secured to the pad support plate by screws or bolts 92 (see FIG. 4). In addition, a passageway 94 may extend through the center of the pad support plate, and an aperture 96 may be formed in the pad support plate.

Figure 4:
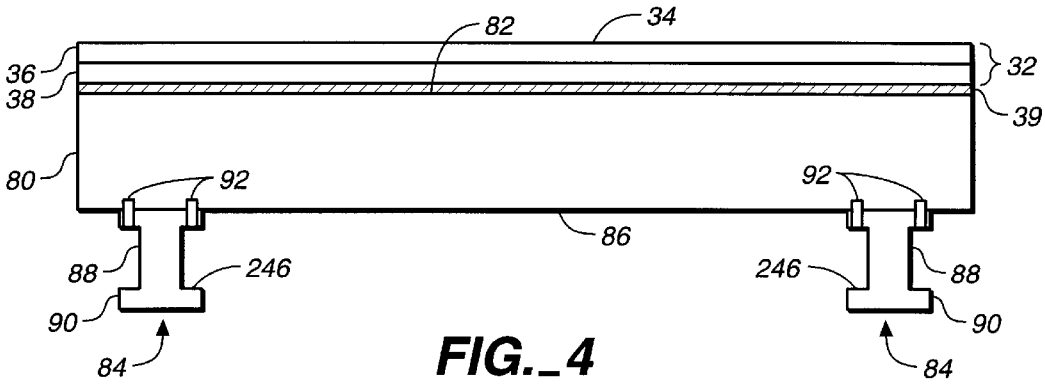
FIG. 4 is a cross-sectional view of a pad support plate of FIG. 2 with an attached polishing pad.

Referring to FIG. 4, polishing pad 32 is shown attached to top surface 82 of pad support plate 80 by means of an adhesive 39. If polishing pad 32 is a standard pad, it comprises a hard composite material having a roughened polishing surface 34. A standard polishing pad typically has a fifty mil thick hard upper layer 36 and a fifty mil thick soft lower layer 38. Upper layer 36 may be composed of polyurethane mixed with fillers. Lower layer 38 may be composed of felt fibers mixed with urethane. A common two layer polishing pad, with the upper layer composed of IC-1000 and the lower layer composed of SUBA-4, is available from Rodel, Inc., located in Newark, Del. (IC-1000 and SUBA-4 are product names of Rodel, Inc.).

If polishing pad 32 is a fixed abrasive pad, upper layer 36 may be a 25–200 mil thick abrasive composite layer, typically composed of abrasive grains held in a binder material. Lower layer 38 may be a 25–200 mil thick backing layer, composed of, for example, a polymeric, paper, cloth, or metallic film. Fixed abrasive polishing pads are described in detail in the following references, all of which are incorporated herein by reference: U.S. Pat. Nos. 5,152,917, issued Oct. 6, 1992, entitled STRUCTURED ABRASIVE ARTICLE; 5,342,419, issued Aug. 30, 1994, entitled ABRASIVE COMPOSITES HAVING A CONTROLLED RATE OF EROSION, ARTICLES INCORPORATING SAME, AND METHODS OF MAKING AND USING SAME; 5,368,619, issued Nov. 29, 1994, entitled REDUCED VISCOSITY SLURRIES, ABRASIVE ARTICLES MADE THEREFROM AND METHODS OF MAKING SAID ARTICLES; and 5,378,251, issued Jan. 3, 1995, entitled ABRASIVE ARTICLES AND METHODS OF MAKING AND USING SAME.

Figure 5:
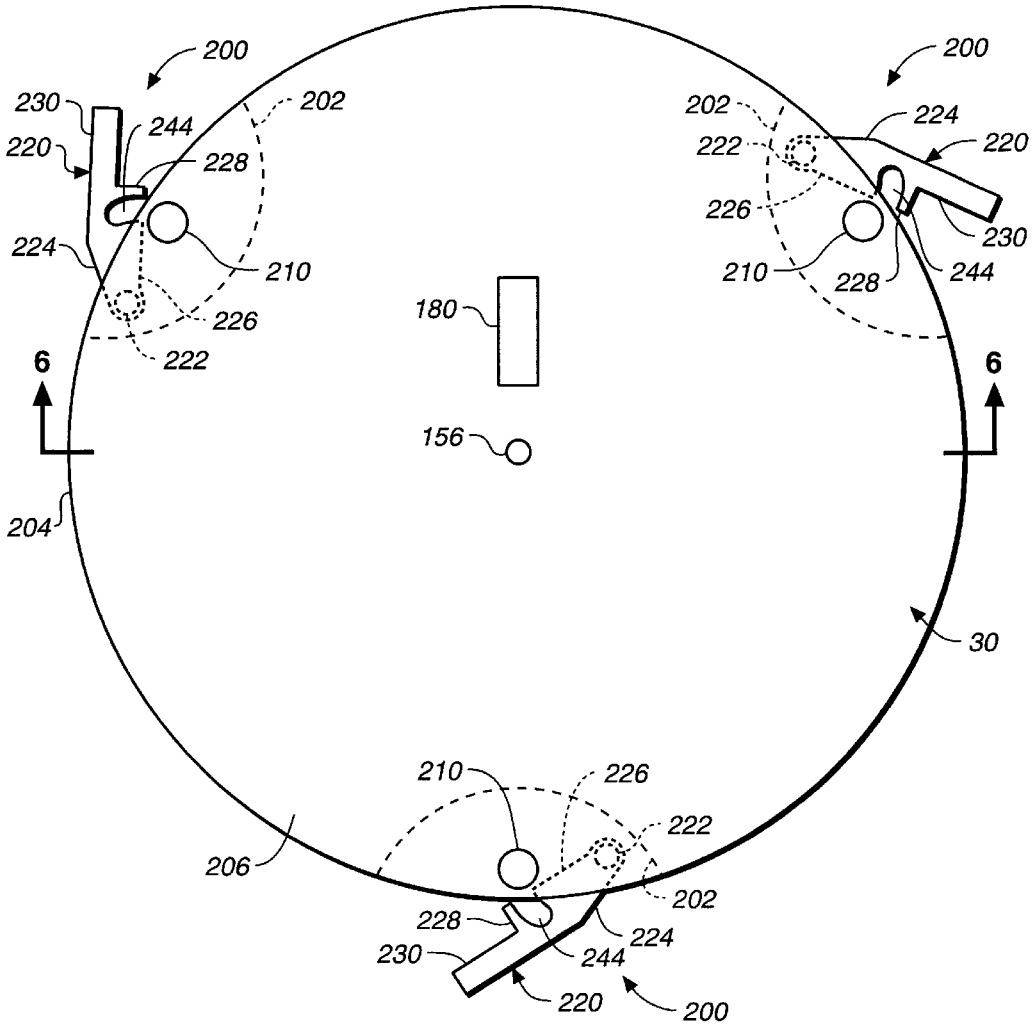
FIG. 5 is a schematic top view of a platen assembly with the fastening arm of the present invention in an open position.

Referring to FIG. 5, each polishing station includes a slurry delivery system to supply slurry to a center port 156 in platen assembly 30. In addition, each polishing station includes a pad fastening system, described in detail below, to mechanically hold the pad support plate and attached polishing pad against the platen assembly during the polishing process.

Figure 6:
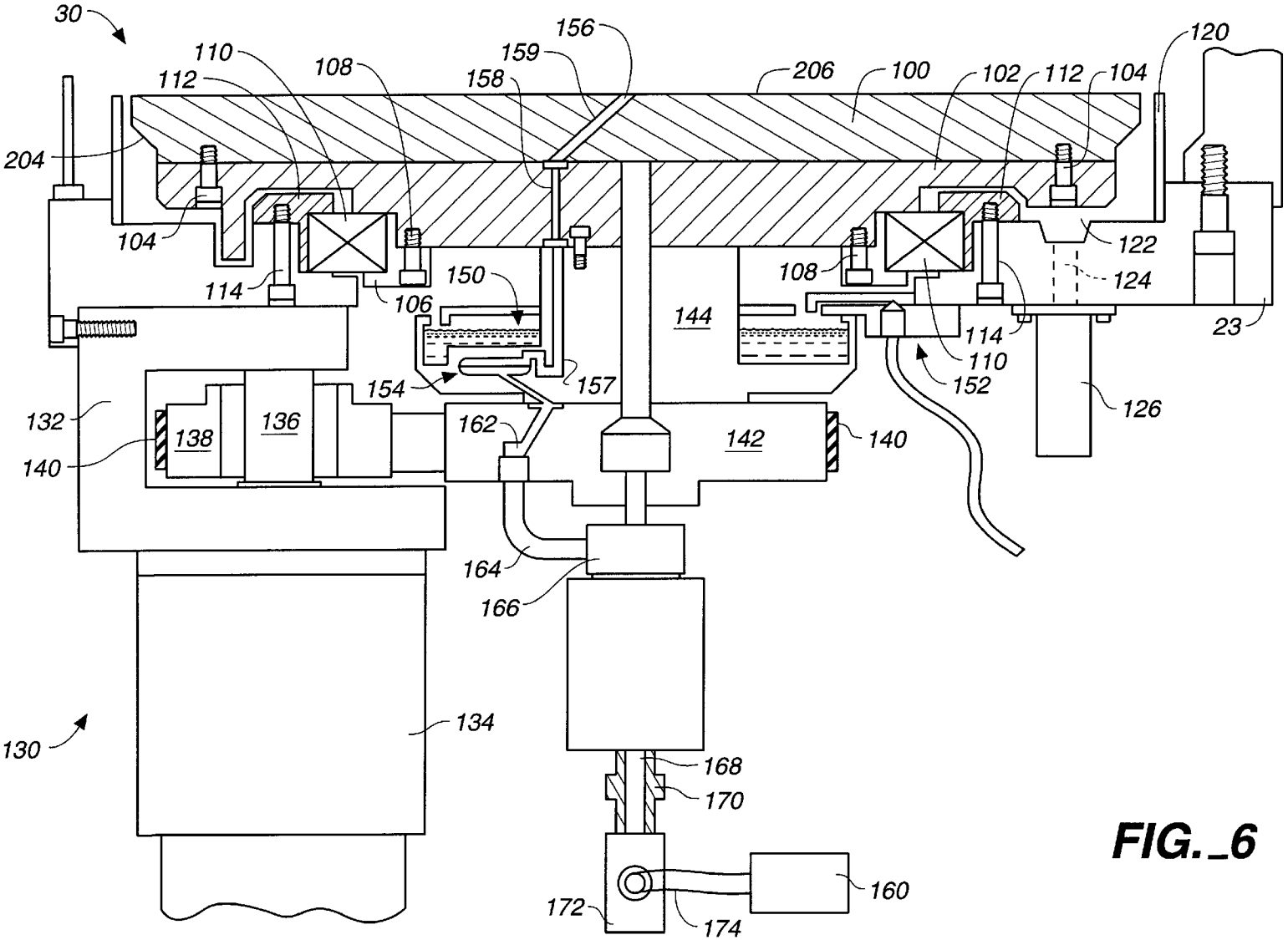
FIG. 6 is a cross-sectional view of the platen assembly of FIG. 5 along line 6—6.

Referring to FIG. 6, the platen or platen assembly may include a platen top 100 and a platen base 102 joined by several peripheral screws 104 counter-sunk into the bottom of the platen base. An O-ring (not shown), or any other suitable sealant, such as an RTV compound, may be used to form a seal between platen top 100 and platen base 102. Alternately, the platen or platen assembly may be formed from a single body. A first collar 106 is connected by screws 108, for example, to the bottom of platen base 102 to capture the inner race of an annular bearing 110. A second collar 112, connected to table top 23 by a set of screws 114, captures the outer race of annular bearing 110. Annular bearing 110 supports the platen assembly above table top 23 while permitting the platen assembly to be rotated by a platen drive motor 134.

A circular weir 120 surrounds the platen assembly and captures slurry and associated liquids centrifugally expelled from the top surface of platen top 100. The slurry collects in a trough 122 formed on table top 23 by weir 120 and second collar 112. The slurry then drains through a fluid passage 124 in table top 23 to a drain pipe 126.

A platen motor assembly 130 is bolted to the bottom of table top 23 through a mounting bracket 132. Platen motor assembly 130 includes motor 134 which has an output shaft 136. Output shaft 136 is joined to a solid motor sheave 138. A drive belt 140 winds around motor sheave 138 and around a hub sheave 142. Hub sheave 142 is joined to platen base 102 by a platen hub 144. Thus, motor 134 may rotate the platen assembly. The platen hub is sealed to lower platen base 102 and to hub sheave 142.

As mentioned above, each polishing station includes a slurry delivery system to provide slurry to center port 156 in platen assembly 30. A description of the slurry delivery system may be found in U.S. patent application Ser. No. 08/549,481, entitled APPARATUS AND METHOD FOR DISTRIBUTION OF SLURRY IN A CHEMICAL MECHANICAL POLISHING SYSTEM, filed Oct. 27, 1995, by William Guthrie, et al., and assigned to the assignee of the present application, the entire disclosure of which is incorporated herein by reference.

In brief, the slurry delivery system includes a slurry reservoir 150 which may be located below the platen assembly. A stationary slurry feed assembly 152 may provide slurry to reservoir 150, and a rotating pump 154 may pump slurry from reservoir 150 to center port 156 through a passage 157 in platen hub 144, a passage 158 in platen base 102, and a passage 159 in platen top 100. Pump 154 may be pneumatically powered by a pneumatic source 160 installed in or adjacent to machine base 22. Pump 154 may be connected to pneumatic source 160 by a passage 162 in hub sheave 142, a flexible pneumatic line 164, a coupling 166, an axial passage 168 in a rotating motor drive shaft 170, a rotary coupling 172, and a flexible pneumatic line 174.

Returning to FIG. 5, platen top 100 and platen base 102 also may include an aperture 180 that allows interferometric monitoring of the polishing process. A description of the use of laser interferometry to monitor a CMP process is found in U.S. patent application Ser. No. 08/605,769, entitled APPARATUS AND METHOD FOR IN-SITU MONITORING OF CHEMICAL MECHANICAL POLISHING OPERATIONS, filed Feb. 22, 1996, by Manoocher Birang et al., and assigned to the assignee of the present invention, the entire disclosure of which is incorporated herein by reference.

Referring to FIGS. 5, 7, 8 and 9, each polishing station includes a pad fastening system to mechanically secure the pad support plate and attached polishing pad to the platen assembly. The pad fastening system may include a plurality of fastening assemblies or fasteners 200 spaced at equal angular intervals about the periphery of the platen assembly. Although three fastening assemblies 200 are illustrated, the polishing station could include just one or two or as many as four or more such assemblies. Each fastening assembly 200 includes a cavity 202 formed in an outer circumferential wall portion 204 of platen assembly 30. Cavity 202 may extend beneath an upper surface 206 of platen top 100. The cavity may be formed by machining a recess into a lower surface 208 of platen top 100. When platen base 102 is secured to platen top 100, the space therebetween forms cavity 202. Each cavity 202 is shown in phantom in FIGS. 5 and 7 because they are located beneath upper surface 206 of platen top 100.

At each fastening assembly 200, a passage 210 extends through platen top 100 between upper surface 206 and cavity 202. Each passage 210 may be generally cylindrical in shape, and may have a diameter which is greater than the diameter of head 90 of fastening pin 84. The passage 210 may extend vertically through platen top 100.

To conduct polishing operations, pad support plate 80, with attached polishing pad 32, is lowered toward platen assembly 30 so that fastening pins 84 fit through respective passages 210 and into cavities 202. Thus, underside 86 of pad support plate 80 rests on upper surface 206 of platen top 100.

The heads of fastening pins 84 may have different diameters or shapes. In this situation, the diameters and shapes of passages 210 may be selected so that each head 90 fits through only one passage 210. This ensures that pad support plate 80 may be positioned on platen assembly 30 in only one orientation. This will align aperture 96 in the pad support plate with aperture 180 in the platen assembly to provide an unobstructed window for interferometric monitoring of the polishing process. In addition, when pad support plate 80 is secured to platen assembly 30 in this fashion, passageway 94 is aligned with center port 156 to provide a passageway for the slurry.

Figure 7:
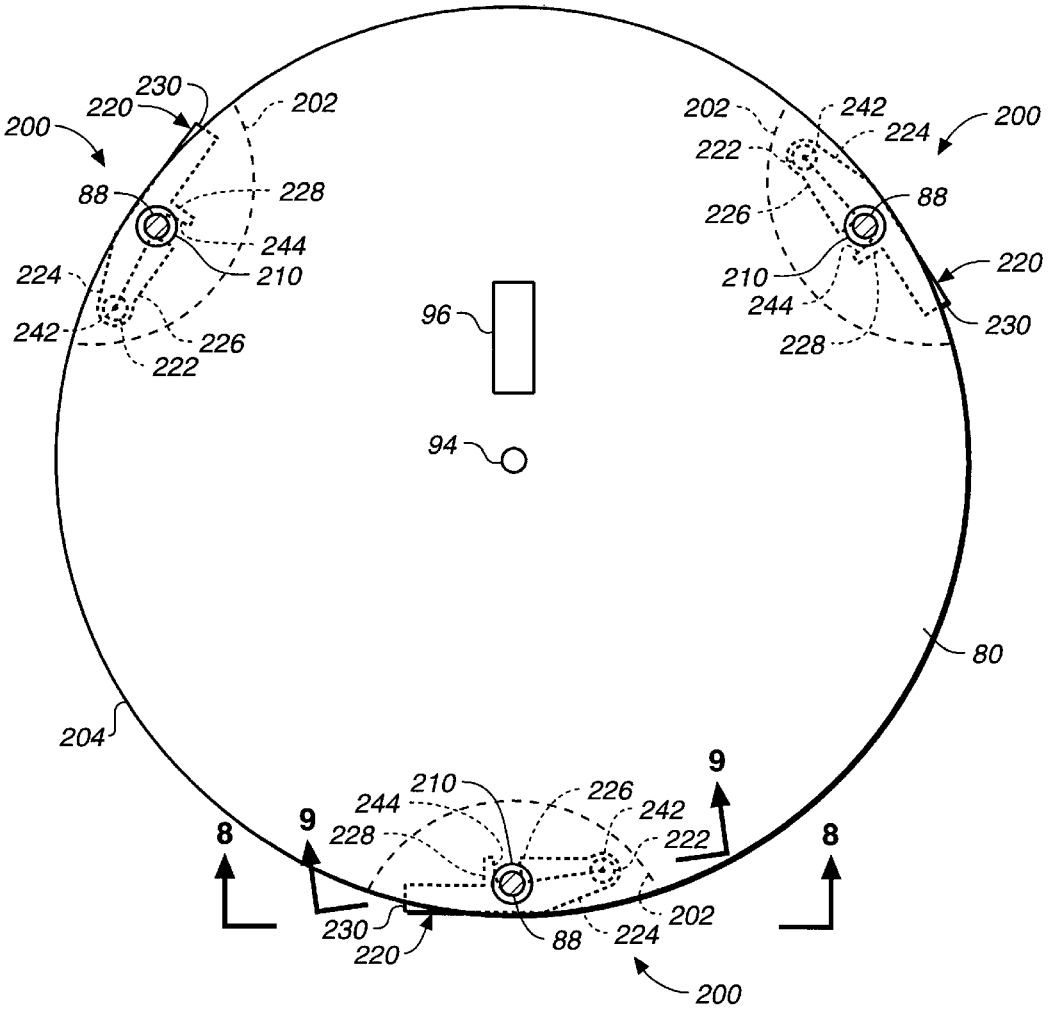
FIG. 7 is a schematic top view of a platen assembly with a pad support plate with the fastening arm of the present invention in a closed position.

Referring to FIGS. 5, 7, 8 and 9, each fastening assembly 200 includes a fastening arm 220 positioned at least partially inside cavity 202. In FIGS. 5 and 7, the portions of each fastening arm 220 located beneath upper surface 206 of platen top 100 are shown in phantom.

Figure 10:
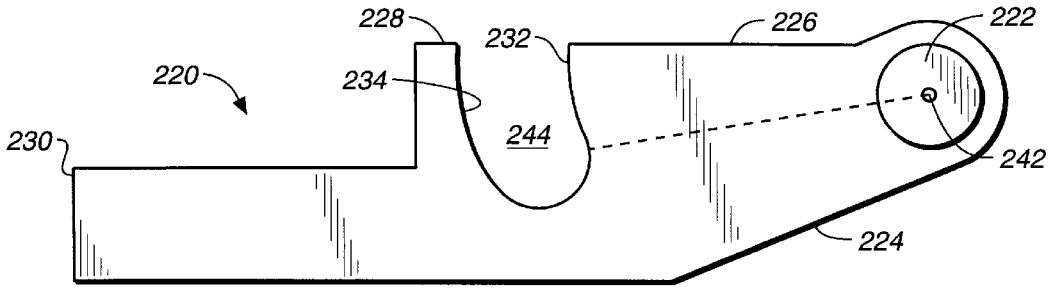
FIG. 10 is a schematic top view of a fastening arm used in a fastening assembly.
Figure 8:
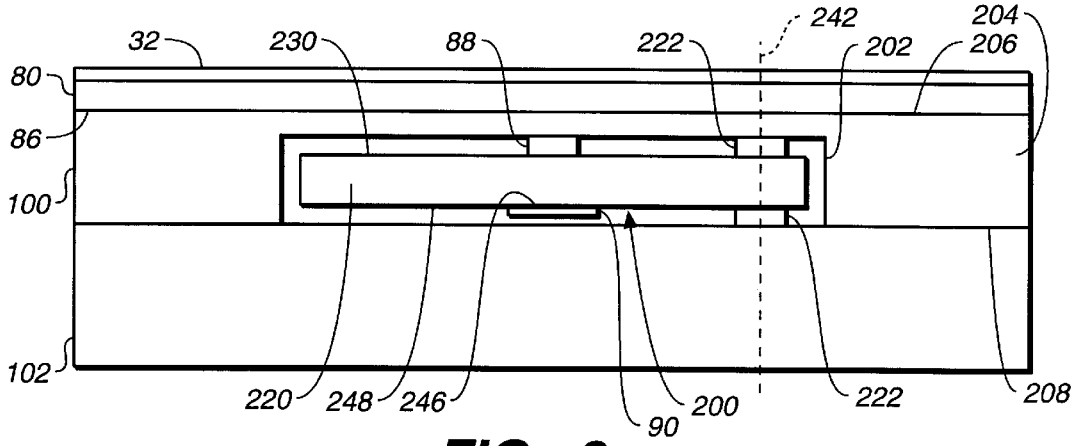
FIG. 8 is a side view of FIG. 7 along line 8—8.

Referring to FIG. 10, each fastening arm 220 may comprise a generally elongated body, including a cylindrical boss 222 projecting from the top and bottom surfaces of a wide arm portion 224. An inner finger portion 226 and an outer finger portion 228 may project from an interior side (relative to the closed side of the cavity) of the fastening arm. In addition, fastening arm 220 may have a handle portion 230 at the end of the arm opposite boss 222. A surface 232 of inner finger 226 and a surface 234 of outer finger 228 extend along circular arcs of two concentric circles having a common radial center at an axis 242 extending approximately through the center of boss 222.

Figure 9:
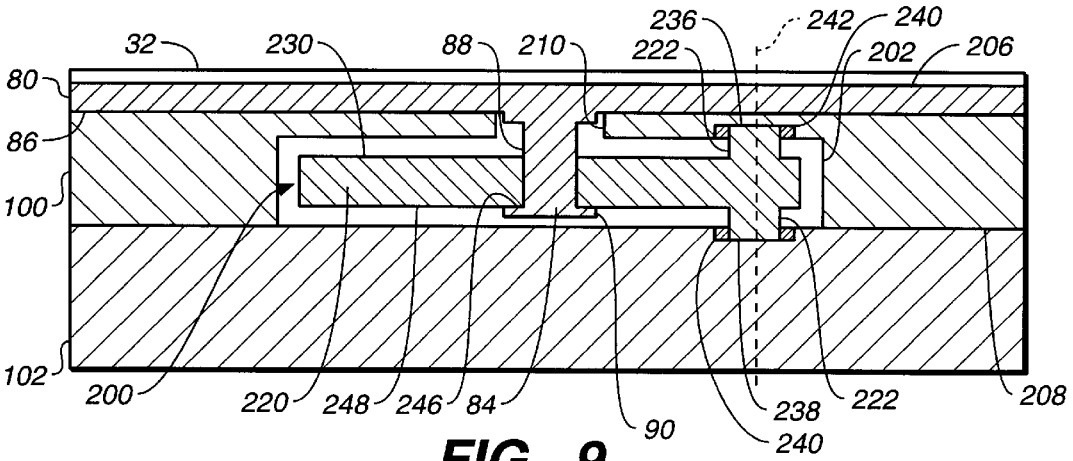
FIG. 9 is a cross-sectional view of FIG. 7 along line 9—9 which passes through the pivotal axis of the fastening arm and the fastening pin of one fastening assembly.

Referring to FIG. 9, the opposite ends of cylindrical boss 222 fit into receiving recesses 236 and 238 in platen top 100 and platen base 102, respectively. Bearings 240 may support the ends of boss 222 in recesses 236 and 238 so that fastening arm 220 can pivot about an axis 242.

Referring to FIGS. 5 and 7, the fastening arms may be pivoted between a closed position and an open position. In the closed position, shown in FIG. 7, fingers 226 and 228 extend around shank 88 of fastening pin 84. In the open position, shown in FIG. 5, the fastening arm is pivoted outwardly so that fingers portions 226 and 228 no longer engage shank 88. The fastening arms 220 may be moved manually between the closed and open positions by means of handle portion 230. One or more portions of circular weir 120 may be removed to provide access to the fastening arms.

As shown most clearly by FIGS. 7 and 9, when a fastening arm 220 is in the closed position, the shank of each fastening pin 84 fits into a gap 244 (see also FIGS. 5 and 10) between finger portions 226 and 228. In addition, an upper annular surface 246 (see also FIG. 4) of head 90 of fastening pin 84 lies flush against a lower surface 248 of fastening arm 220. Thus, the fastening arm of each fastening assembly engages its associated fastening pin to prevent the pad support plate from being lifted off the platen assembly. In addition, because shank 88 fits snugly in gap 244, inner finger 226 and outer finger 228 securely hold fastening pins 84 in place to prevent pad support plate 80 from rotating. Furthermore, because inner surface 234 and outer surface 232 extend along radial arcs with centers at axis 242, rotational forces exerted on pad support plate 80 and fastening pins 84 do not generate a significant moment of inertia which would cause fastening arm 220 to pivot about axis 242.

When it is time to replace polishing pad 32, fastening arms 220 may be moved into the open position and pad support plate 80 may be lifted off platen assembly 30. A new pad support plate with a fresh polishing pad may then be positioned on the platen assembly. The fastening arms can then be moved to their closed position to secure the pad support plate to the platen assembly. The used polishing pad may be removed from the pad support plate and a fresh polishing pad attached. Thus, the pad fastening system provides a simple and quick way to remove and reattach a polishing pad to the platen assembly. In addition, because one pad support plate may be used while a fresh polishing pad is being attached to another pad support plate, the down time required to exchange polishing pads is reduced and the throughput of the CMP apparatus is increased.

The present invention has been described in terms of a preferred embodiment. The invention, however, is not limited to the embodiment depicted and described. Rather, the scope of the invention is defined by the appended claims.

What is claimed is:

1. A chemical mechanical polishing apparatus, comprising:

a pad support plate having a projection extending from a bottom surface thereof;

a polishing pad attachable to a top surface of the pad support plate;

a rotatable platen configured to support the pad support pad plate, the platen including an aperture to receive the projection; and a fastener coined to the rotatable platen, the fastener configured to engage the projection and secure the pad support plate to the platen.

2. The apparatus of claim 1, further comprising a slurry supply, a passage through the platen, and a pump to pump slurry from the slurry supply through the passage to a top surface of the platen.

3. The apparatus of claim 1 wherein the platen includes a cavity, and the fastener is at least partially disposed in the cavity.

4. The apparatus of claim 3, wherein the aperture provides a passage between a top surface of the platen and the cavity, and the projection extends into the cavity.

5. The apparatus of claim 4, wherein the fastener includes an arm pivotally movable between a first position in which the arm engages the projection and a second position in which the arm does not engage the projection.

6. The apparatus of claim 5 wherein the arm includes two finger portions forming a gap therebetween, and wherein in the first position a shank of the projection is located in the gap between the two finger portions.

7. The apparatus of claim 6 wherein the projection includes a head having a diameter greater than the distance across said gap such that in the first position, a top surface of the head contacts a bottom surface of the arm.

8. A chemical mechanical polishing apparatus, comprising:

a rotatable platen having a recess in a surface thereof; and an arm positionable at least partially in the recess and pivotally movable between a first position in which the arm engages a projection of a pad support plate and a second position in which the arm does not engage the projection.

9. The apparatus of claim 8 wherein the arm includes two finger portions forming a gap therebetween, and wherein in the first position the projection is located in the gap between the two finger portions.

10. The apparatus of claim 8 wherein the recess is located on an outer cylindrical surface of the platen.

11. The apparatus of claim 10, wherein the platen includes a passage between a top surface of the platen and the recess.

12. An article for use with a chemical mechanical polishing apparatus, comprising:

a substantially rigid disk-shaped member;

a plurality of pins projecting from a bottom surface of the disk-shaped member, the pins positioned and configured to fit into apertures in a top surface of a platen; and a polishing pad attachable to a top surface of the disk-shaped member.

13. A chemical mechanical polishing apparatus, comprising:

a pad support plate having a plurality of pins extending from a bottom surface thereof;

a polishing pad attached to a top surface of the pad support plate;

a rotatable platen having a top surface to support the pad support pad plate, the platen having a plurality of cavities and a plurality of apertures connecting the top surface to the cavities and configured to receive the pins; and a plurality of fasteners connected to the platen, each fastener disposed at least partially in one of the cavities and movable between a first position in which the fastener engages one of the pins to secure the pad support plate to the platen and a second position in which the fastener does not engage that pin.

14. The apparatus of claim 13, wherein the platen includes a platen top having a plurality of recesses formed in a bottom surface thereof, and a platen base secured to the bottom surface of the platen top, the recesses between the platen top and platen base forming the cavities.

15. The apparatus of claim 13, wherein the apparatus includes three cavities, three fasteners and three pins.

16. The apparatus of claim 13 wherein the plurality of fasteners are disposed at equal angular intervals about the periphery of the platen.

17. The apparatus of claim 13 wherein each fastener includes an arm pivotally attached to the platen, the arm including two finger portions forming a gap therebetween, and wherein in the first position the projection is located in the gap between the two finger portions.

18. A method of securing a polishing pad to a platen, comprising:

attaching the polishing pad to a pad support plate having a projection extending from a bottom surface thereof;

positioning the pad support plate on a platen so that the projection extends at least partially into an aperture in the platen; and moving a fastener connected to the platen to engage the projection.

* * * * *

UNITED STATES PATENT AND TRADEMARK OFFICE

CERTIFICATE OF CORRECTION

PATENT NO. : 5,931,724

DATED : August 3, 1999

INVENTOR(S) : Perlov et al.

It is certified that error appears in the above-identified patent and that said Letters Patent is hereby corrected as shown below:

In Claims,
Claim 1, column 8, line 65, change "coined" to --joined--.

Signed and Sealed this
First Day of February, 2000

*Attest:*

Q. TODD DICKINSON

*Attesting Officer*

*Acting Commissioner of Patents and Trademarks*